United States Patent [19]

Rebel

[11] 4,408,525

[45] Oct. 11, 1983

[54] ARRANGEMENT FOR LOW-VIBRATION SHEET TRANSFER BETWEEN PRINTING UNITS ON MULTI-COLOR PRINTING PRESSES

[75] Inventor: Herbert Rebel, Rodgau, Fed. Rep. of Germany

[73] Assignee: M.A.N.-Roland Druckmaschinen Aktiengesellschaft, Fed. Rep. of Germany

[21] Appl. No.: 333,380

[22] Filed: Dec. 22, 1981

[30] Foreign Application Priority Data

Dec. 24, 1980 [DE] Fed. Rep. of Germany ... 8034521[U]

[51] Int. Cl.[3] ..... B41F 21/00

[52] U.S. Cl. ..... 101/183; 101/177

[58] Field of Search ..... 101/177, 183; 271/204, 271/206, 241, 277

[56] References Cited

U.S. PATENT DOCUMENTS

| | | | |
|---|---|---|---|
| 2,756,995 | 7/1956 | Koch | 271/277 |
| 2,821,390 | 8/1958 | Norton | 271/277 |
| 3,591,169 | 7/1971 | Preuss | 271/206 |
| 3,767,929 | 3/1974 | Deacon et al. | 271/204 |
| 4,260,149 | 4/1981 | Melzer | 271/241 |

*Primary Examiner*—Edgar S. Burr
*Assistant Examiner*—Bradley M. Lewis
*Attorney, Agent, or Firm*—Leydig, Voit, Osann, Mayer & Holt, Ltd.

[57] ABSTRACT

An arrangement for the transfer and conveyance of sheets between first and second printing units of a multicolor lithographic press which includes a receiving drum in the first printing unit, a feed drum in the second printing unit, impression cylinders associated with the drums, an endless chain, which includes links joined by pins, trained about the drums, and a guide rail following the path of the chain. A plurality of gripper carriages moveable on the rail are each coupled to the chain for movement therewith by a carriage coupler, each coupler including a drive roller on the chain mounted outboard parallel to the pins thereof. Each gripper carriage includes a yoke for snugly embracing the drive roller on the chain. The feed drum includes a radially mounted drive fork for engaging the cam roller of each gripper carriage as it comes into the vicinity of the feed drum in order to achieve a condition of accurate register between the feed drum and the gripper carriage. Each yoke is resiliently mounted with respect to its carriage to permit slight accommodating movement of the carriage along the direction of the chain so that each carriage is sequentially in a phase position which is dependent only upon the phase position of the feed drum for accurately phased transfer of the sheet with respect to the associated impression cylinder.

4 Claims, 5 Drawing Figures

ARRANGEMENT FOR LOW-VIBRATION SHEET TRANSFER BETWEEN PRINTING UNITS ON MULTI-COLOR PRINTING PRESSES

The present invention relates generally to an arrangement for the transfer and conveyance of sheets between the printing units of a multi-color lithographic press. More particularly, the invention relates to a sheet transfer and conveyance arrangement of the type having a receiving drum in the first printing unit, a feed drum in the second printing unit, each drum having an associated impression cylinder, an endless chain including links joined by pins and trained about the drums, a guide rail following the path of the chain, and a plurality of gripper carriages moveable on the rail and coupled to the chain for movement therewith.

In a multi-color lithographic printing press, a sheet is typically transferred and conveyed between the receiving drum of the first printing unit and the feed drum of the second printing unit by gripper carriages carried by an endless chain trained about the drums. Typically the operation of the endless chain is timed such that the gripper carriage arrives at the position for sheet transfer simultaneously with the gripper on the impression cylinder to effect the desired sheet transfer in register. A problem which has been encountered, however, is that the sheet is not transferred from the gripper carriage to the impression cylinder in exact register due to relative movement of the carriage caused by, for example, vibration of the chain due, for example, to production tolerances in the chain links, improper chain tensioning, play resulting from wear, and the like. This causes undesirable color misregister on the printed sheet.

This problem has been recognized for years and transfer arrangements have been devised in an effort to overcome it. One such arrangement is shown in German patent No. 2,037,262 which describes a construction wherein the gripper system includes a gripper carriage indirectly connected to the chain via couplings and a cam-controlled fork which is forced by a spring against the centering roller of the gripper carriage to center the carriage as the gripper system approaches the transfer area. This arrangement, however, is not entirely satisfactory as the alignment of the gripper carriage is highly complicated, and, since only one spring acts on the gripper carriage, inaccuracies in sheet alignment occur in the event the chain is not properly tensioned. In addition, since the gripper system can be moved only on a circular path with respect to the chain, any relative movements of the chain are transmitted directly to the gripper system undampened, further contributing to inaccurate sheet registration during transfer.

Another arrangement which has been disclosed is that shown in German application DE-AS No. 1,224,753. In that arrangement the drum carries a prismatic-shaped fork which includes a hook-shaped claw member for engaging the centering roller of the gripper carriage, the gripper carriage being mounted flexibly on the chain. As the gripper carriage approaches the transfer area it is engaged by the claw member of the fork. Due to the flexible coupling between the chain and gripper carriage, the gripper carriage is subject to vibration in all directions. Moreover, where the position of the gripper carriage as it approaches the prismatic fork deviates from its required position, it has a tendency to be abruptly centered by the hook-shaped claw thereby creating a jolt as it is engaged by the claw which causes inaccurate register of the sheet with the impression cylinder. Finally, the design of this arrangement is complex and it cannot be easily maintained.

It is, accordingly, an object of the present invention to provide an arrangement for the transfer and conveyance of sheets between the first and second printing units of a multicolor lithographic printing press in which the sheets are transferred in accurate phase to the impression cylinder so that there is no color misregister.

Another object of the invention is to provide an arrangement for the transfer and conveyance of sheets with minimal vibration. It is a related object to provide an arrangement wherein vibrational chain movements which may be transmitted to the gripper carriage are dampened.

Yet another object of the invention is to provide an arrangement wherein the gripper carriage is connected resiliently to the chain in the driving direction so that any instability caused by chain running, improper chain tensioning, play due to wear or the like are not transmitted to the gripper carriage during sheet transfer. A related object provides for an indirect coupling arrangement between the chain and gripper carriage that is of simpler construction, is easier to install and maintain, and is more economical than arrangements heretofore known.

A further object of the invention lies in the provision of an arrangement for the transfer and conveyance of sheets between the printing units of a multi-color lithographic printing press wherein the gripper carriage is in a phase position which is dependent only upon the phase position of the feed drum for accurately phased transfer of the sheet thereon to the associated impression cylinder.

It is yet another object of the present invention to provide an arrangement for the transfer and conveyance of sheets between the printing units of a multicolor lithographic printing press wherein the feed drum is provided with a drive fork which is so constructed as to reduce the jolt to the gripper carriage when the centering roller of the gripper carriage enters the mouth of the fork as the gripper carriage is engaged by the fork to achieve a condition of accurate register between the feed drum and the gripper carriage.

These and other objects and advantages of the present invention will become apparent upon reading the following detailed description and upon reference to the drawings in which.

While the invention will be described in connection with a preferred embodiment, it will be understood that there is no intention to limit the invention to the construction shown, but I intend, on the contrary to cover the various alternative and equivalent constructions included within the spirit and scope of the appended claims.

Figure 1:
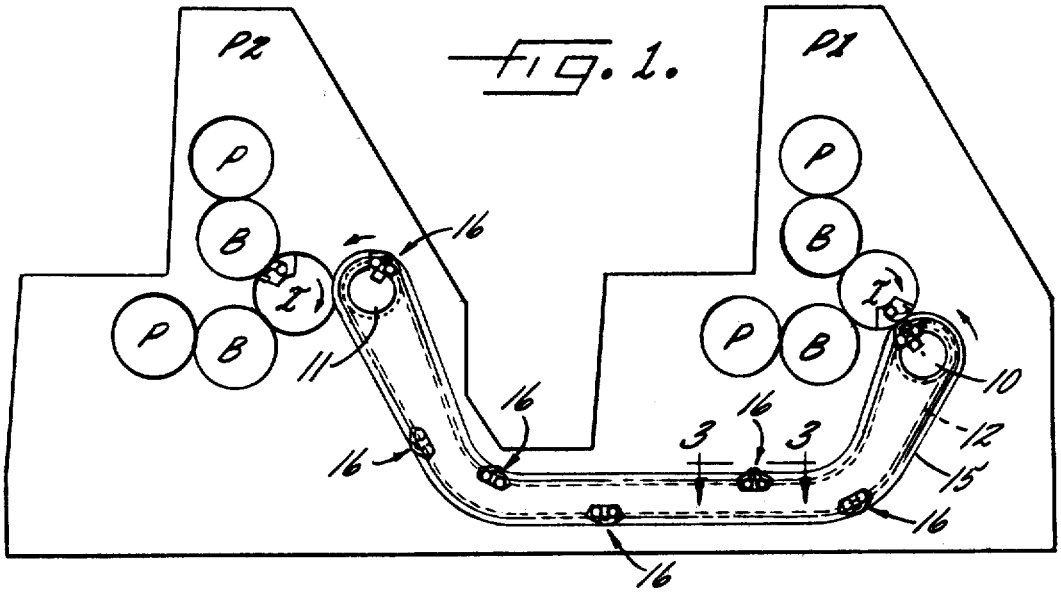
FIG. 1 is a diagrammatic elevational view of a typical multi-color lithographic printing press which includes a sheet transfer and conveyance arrangement in accordance with the present invention.

Turning now to FIG. 1, there is shown a typical multi-color lithographic printing press which includes two printing units P1 and P2, respectively. Each printing unit includes two plate cylinders P offsetting onto a pair of blanket cylinders B which cooperate with a single impression cylinder I carrying a sheet (not shown) to which the printed impressions are applied in succession. A receiving drum 10 in the first printing unit is associated with the impression cylinder of that unit and a feed drum 11 in the second printing unit is associated with the impression cylinder in that unit. An endless chain 12 which includes links 13 (see FIG. 3) joined by pins 14 is trained about the drums and driven at "press speed" by drive means not shown. A guide rail 15 follows the path of the chain for guiding gripper carriages 16 which are coupled to the chain for movement therewith. The carriages 16 each have a set of rollers 17 which engage the guide rail.

Sheets (not shown) are conveyed seriatim from the impression cylinder I of the first printing unit P1 to the impression cylinder I of the second printing unit P2 by the chain via gripper carriages 16 well known to those skilled in the art, and having a gripper pad construction such as that described, for example, in U.S. Pat. No. 3,972,413.

In accordance with the sheet transfer and conveyance arrangement of the present invention, a carriage coupler is provided for coupling each carriage to the chain for movement therewith. Each gripper carriage includes a cam roller for positioning the carriage in register with the impression cylinder. Drive forks are radially mounted on the feed and receiving drums for engaging the cam roller of the gripper carriage as the carriage comes into the vicinity of either drum to achieve a temporary condition of accurage register between the drum and the carriage. The carriage coupler includes a resiliently mounted yoke engaging a drive roller on the chain so as to permit slight accommodating movement of the carriage along the moving direction of the chain when the drive fork is engaged so that each carriage is at the time of sheet transfer sequentially in phase position which is dependent only upon the phase position of the drum for accurately phased and vibration-free transfer of the sheet on the carriage to the associated impression cylinder.

Figure 2:
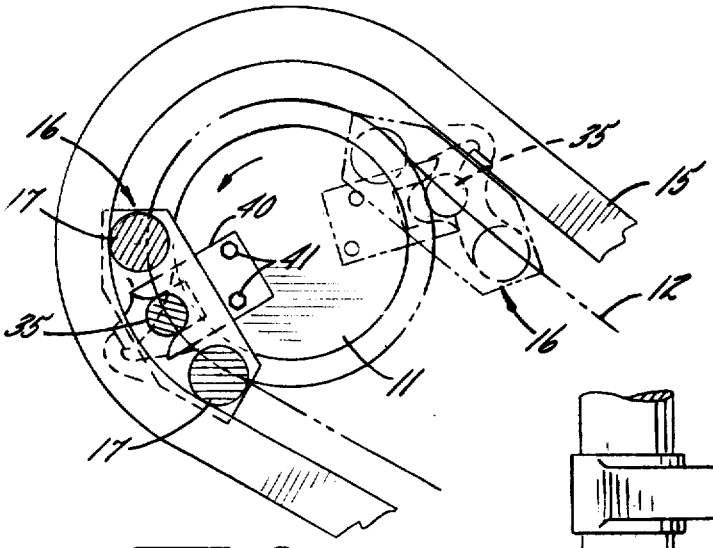
FIG. 2 is an enlarged fragmentary view, partially in section, of the chain and gripper carriage and the feed drum which drives it as viewed in FIG. 1.
Figure 3:
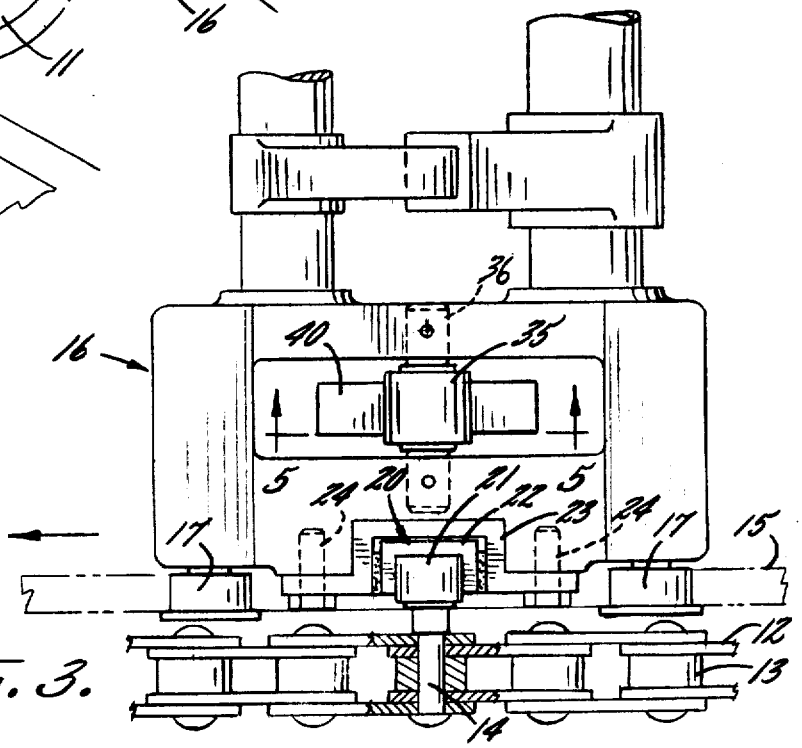
FIG. 3 is a view of the inventive arrangement as viewed along line 3—3 in FIG. 1.

Turning to FIGS. 2 and 3, the carriage coupler 20 includes a drive roller 21 on the chain 12 co-axially mounted outboard on one of the pins 14 of the chain and in any event parallel to the pins. Each gripper carriage 16 has a yoke 22 for snugly embracing the drive roller 21 on the chain 12 so that the carriage is coupled to the chain for movement therewith. The yoke 22 is carried by a mounting pad 23 which is rigidly secured to the body of the gripper carriage, as for example in the illustrative embodiment of FIG. 3, by bolts 24.

Figure 4:
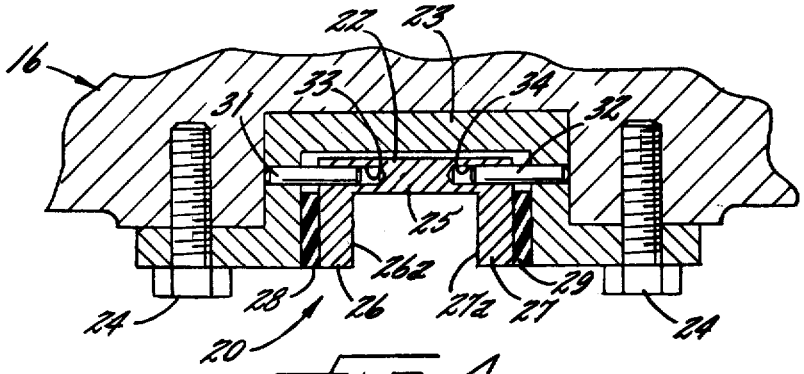
FIG. 4 is an enlarged sectional view of the gripper carriage portion of the coupler carriage based upon FIG. 3.

As shown in FIG. 4, the yoke 22 is of generally "U" shape having a base portion 25 and two opposed legs 26, 27. The inner surfaces *26a*, *27a*, of the two opposed legs, respectively, are so dimensioned as to snugly embrace the drive roller 21 and lie in the plane of the chain for longitudinal driving of the carriage, while permitting free movement of the drive roller 21 at right angles thereto. In carrying out the invention the yoke 22 is resiliently mounted with respect to the gripper carriage 16 to permit slight accommodating movement of the carriage along the direction of the chain as the carriage is moved by the chain from one printing unit to the next. Thus interposed between the yoke 22 and the mounting pad 23 are dampening elements 28,29 in the form of pads of rubber or similar resilient material.

The yoke 22 may be joined to the mounting pad 23 in any suitable manner provided the yoke snugly engages the drive roller 21 of the gripper carriage and is resiliently mounted to permit slight accommodating movement of the carriage along the direction of the chain. In the illustrative embodiment (FIG. 4), yoke 22 is mounted on the mounting pad 23 by means of a telescoping pin connection. The mounting pad 23 mounts a pair of aligned pins 31,32 which are slidably received in aligned bores 33,34, respectively, formed in the yoke 22. This limits relative movement to that which takes place resiliently in the driving direction.

Figure 5:
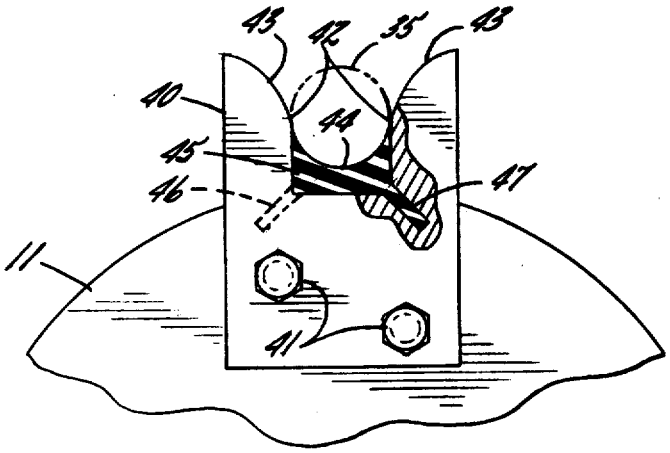
FIG. 5 is an enlarged partially sectional view of the drum fork viewed along line 5—5 in FIG. 3.

Further in accordance with the present invention, the sheet transfer and conveyance arrangement includes drive forks radially mounted to the respective receiving and feed drums for engaging a cam roller on each gripper carriage as the gripper carriage comes into the vicinity of the respective drum. Thus I provide on each carriage a cam roller 35 mounted on a short cross shaft 36 secured in the carriage frame. Positioned for engagement with the roller is a drive fork 40. The drive fork 40 is rigidly mounted to the drum by means of bolts 41 and rotates with the drum. As shown in FIG. 5, the drive fork 40 has opposed inner positioning surfaces 42 with lead-in surfaces 43 and a root 44, which, taken together, form a generally sinusoidal profile. In the illustrative embodiment, the root 44 is lined with a pad or "embedment" 45 of resilient material such as, for example, polyurethane foam. This, together with the curved lead-in surfaces 43, serves to dampen or cushion any radial jolt to the gripper carriage 16 as the cam roller 35 is engaged by the drive fork. The resilient material may be anchored in the notch by any suitable means. For example, as shown in FIG. 5, the drive fork is provided with angular grooves 46,47 which receive integral arms of the resilient material which extend from the central portion thereof into the grooves to thereby anchor the resilient material in the notch.

Turning now to FIG. 2, it will be assumed that the gripper carriage 16 has just been driven by the yoke 22, free of vibration, to the position shown in phantom by the chain 12. As the gripper carriage 16 comes into the vicinity of the drum, one of the lead-in surfaces 43 of the drive fork 40 engages the cam roller 35 of the gripper carriage and guides it to rest in the root 44. As the drum continues to rotate, the drive fork 40 forces the cam roller 35, and thus the carriage 16, radially outwardly with respect to the drum so that the guide rollers 17 of the gripper carriage 16 are forced resiliently and without play against the guide rail 15, as shown in FIG. 2, the radial movement being permitted by the open-sided nature of the yoke 22. This establishes a condition of precise register of the sheet with respect to the drum 11. In other words the fork 40 "takes over" the driving and positioning of the carriage and sheet just prior to the time that the sheet is to be transferred. Control of the gripper carriage 16 is shifted from the relatively imprecise chain drive to the more precise fork drive. Any disparity of position is accommodated by resilient yielding of the pads 28,29 which support the yoke 22. As a result, each gripper carriage at time of transfer of the sheet is sequentially in a phase position which is dependent only upon the phase position of the drum for accurately phased transfer of the sheet carried by the carriage to the associated impression cylinder. Any play which may develop in the chain as a result of wear cannot affect the accuracy of register. As soon as the sheet has been transferred to the impression cylinder, and upon disengagement of the fork, driving and control are restored to the chain.

It will be understood that similar positioning accuracy is achieved at the receiving drum 10 in the first printing unit and for similar reasons.

It will be apparent that the objects of the invention have been amply fulfilled. Unlike other sheet transfer and conveyance arrangements, with the arrangement of the present invention sheets are transferred and conveyed with minimal vibration, all relative movements between the chain and the carriage in the running direction of the chain are dampened, the gripper carriage is engaged by the fork and driven thereby to achieve a condition of accurate register between the receiving and feed drums and the gripper carriage with the gripper carriage being in a phase position which is dependent only upon the phase position of the feed drum for accurately phased transfer of the sheet to the impression cylinder. Thus, sheets are transferred in accurate phase to the impression cylinder so that there is no color misregister, even in the event of instability caused by chain running, improper chain tensioning, wear and tear to the chain or the like.

I claim as my invention:

1. An arrangement for the transfer and conveyance of sheets between first and second printing units of a multicolor press comprising, in combination, a receiving drum in the first printing unit, a feed drum in the second printing unit having an associated impression cylinder, an endless chain including links joined by pins and trained about the drums, a stationary guide rail following the path of the chain, a plurality of gripper carriages movable with respect to the rail, a carriage coupler for coupling each carriage to the chain for movement therewith, each coupler including a drive roller on the chain mounted outboard parallel to the pins thereof, each gripper carriage having a yoke for snugly embracing the drive roller in the driving direction, each carriage having a cam roller and the feed drum having a radially mounted drive fork defining a notch having a root for engaging the cam roller as the gripper carriage comes in the vicinity of the feed drum, the cam roller being snugly fitted in the notch between the walls of the fork to achieve a condition of accurate register between the feed drum and the gripper carriage, (a) the root of the notch being lined with a pad of resilient material for resiliently pressing the carriage outwardly against the guide rail thereby to insure seating of the cam roller snugly fitted in the notch and (b) the yoke being resiliently mounted with respect to the carriage in the driving direction to permit slight accommodating movement of the carriage with respect to the chain so that each carriage at the time of sheet transfer is sequentially in a phase position which is dependent only upon the phase position of the feed drum for accurately phased transfer of the sheet thereon to the associated impression cylinder.

2. An arrangement for the transfer and conveyance of sheets between first and second printing units of a multicolor press comprising, in combination, a receiving drum in the first printing unit, a feed drum in the second printing unit, each drum having an associated impression cylinder, an endless chain including links joined by pins and trained about the drums, a stationary guide rail following the path of the chain, a gripper carriage movable with respect to the rail, a carriage coupler for coupling the carriage to the chain for movement therewith, the coupler including a drive roller on the chain mounted outboard parallel to the pins thereof, the gripper carriage having a yoke for snugly embracing the drive roller in the driving direction, the carriage having a cam roller and the drums having respective radially mounted drive forks defining a notch having a root for engaging the cam roller as the gripper carriage comes in the vicinity of each drum, the cam roller being snugly fitted in the notch between the walls of the fork to achieve a condition of accurate register between the drum and the gripper carriage, (a) the root of each notch being lined with a pad of resilient material for resiliently pressing the associated carriage outwardly against the guide rail thereby to insure seating of the cam roller snugly fitted in the notch and (b) the yoke being resiliently mounted with respect to the carriage in the driving direction to permit slight accommodating movement of the carriage with respect to the chain in the driving direction as each fork is engaged so that the carriage at the time of sheet transfer is in a phase position which is dependent only upon the phase position of the drum.

3. The combination as claimed in claim 1 or in claim 2 in which the yoke is of "U" shape presenting opposed inner surfaces dimensioned to snugly embrace the drive roller and aligned with the direction of chain movement for driving of the carriage while permitting relative radial movement of the roller at right angles thereto.

4. The combination as claimed in claim 1 or in claim 2 in which the fork defines a notch of generally sinusoidal profile presenting a pair of rounded entry surfaces for guiding the cam roller into a root which is centered between them, the root of the notch being lined with a pad of resilient material.

* * * * *